US005163119A

United States Patent [19]

Windon

[11] Patent Number: 5,163,119

[45] Date of Patent: Nov. 10, 1992

[54] WATER HEATER FOAM DAM FOR PROTECTING ELECTRICAL COMPONENTS

[75] Inventor: Bradley N. Windon, Hartsville, S.C.

[73] Assignee: AOS Holding Company, Wilmington, Del.

[21] Appl. No.: 734,707

[22] Filed: Jul. 23, 1991

[51] Int. Cl.[5] ..... E22B 37/36; F24H 1/18

[52] U.S. Cl. ..... 392/449; 264/46.7; 126/361; 122/13.1

[58] Field of Search ..... 342/449–457; 264/46.9, 46.7, 46.5; 126/361, 374; 122/494, 13.1, 13.2; 220/444, 902

[56] References Cited

U.S. PATENT DOCUMENTS

| | | | |
|---|---|---|---|
| 3,253,731 | 5/1966 | Fink et al. . | |
| 3,288,896 | 11/1966 | Hendricks | 220/444 |
| 3,444,280 | 5/1969 | Pulaski . | |
| 4,372,028 | 2/1983 | Clark et al. | 126/375 |
| 4,527,543 | 7/1985 | Denton . | |
| 4,628,184 | 12/1986 | West | 264/46.9 |
| 4,715,512 | 12/1987 | Buchser . | |
| 4,744,488 | 5/1988 | Nelson . | |
| 4,905,865 | 3/1990 | Yamamoto . | |
| 4,907,570 | 3/1990 | Lemense | 220/444 |
| 5,024,210 | 6/1991 | Nelson | 126/361 |
| 5,040,697 | 8/1991 | Nelson | 126/361 |
| 5,052,346 | 10/1991 | Beck | 392/441 |

FOREIGN PATENT DOCUMENTS

| | | | |
|---|---|---|---|
| 247803 | 8/1984 | German Democratic Rep. | 220/444 |

*Primary Examiner*—Bruce A. Reynolds
*Assistant Examiner*—John A. Jeffery
*Attorney, Agent, or Firm*—David R. Price; James E. Lowe, Jr.

[57] ABSTRACT

A water heater comprising a tank including an outer surface, and including an inner surface defining a water chamber, an electrical component extending outwardly of the outer surface of the tank, an outer jacket surrounding the tank and having therein an opening affording access to the electrical component, a door which is mounted on the outer jacket and which covers the opening, a dam which is located within the opening and surrounds the electrical component, which extends between the tank and the outer jacket, and which includes a portion extending between the door and the outer jacket, and insulating material located between the tank and the outer jacket and outside of the dam.

20 Claims, 2 Drawing Sheets

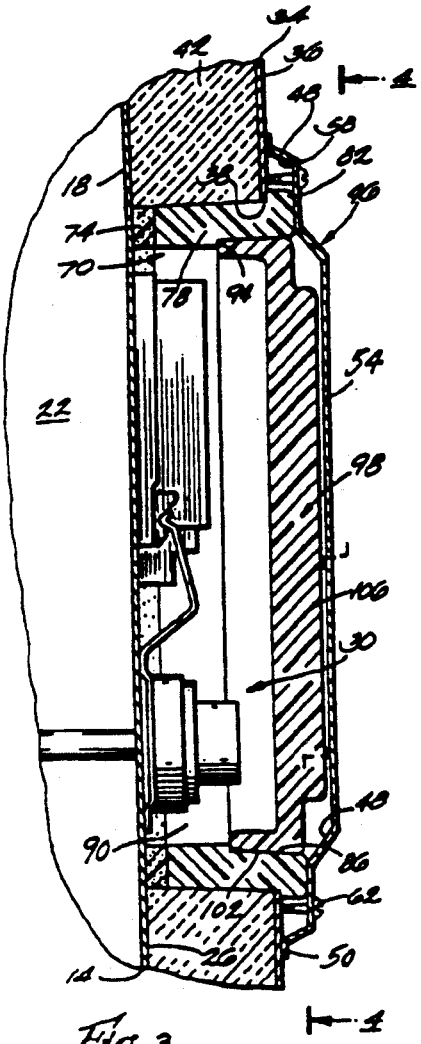
Fig. 3
Fig. 4
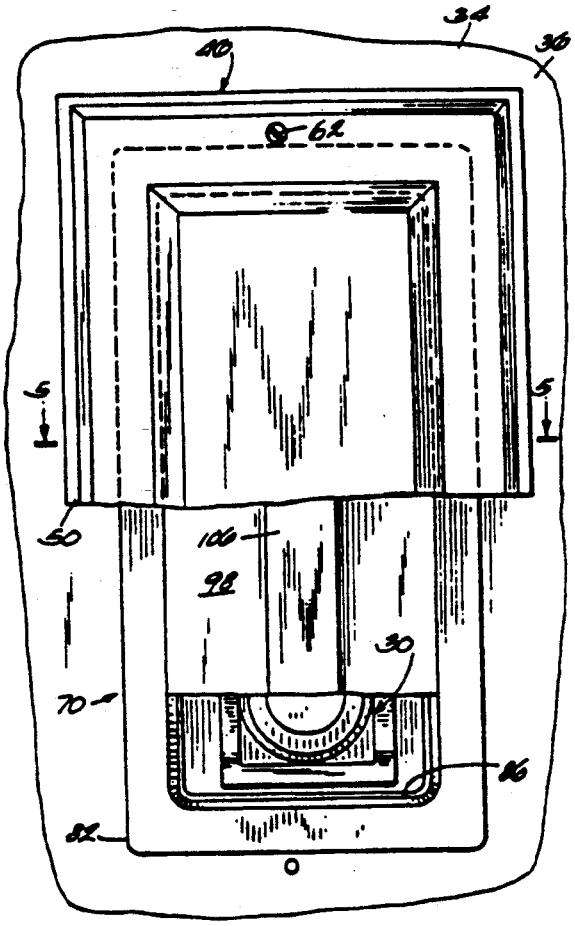
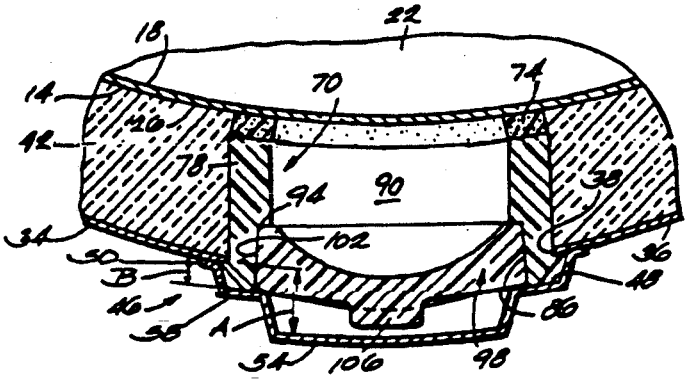
Fig. 5

WATER HEATER FOAM DAM FOR PROTECTING ELECTRICAL COMPONENTS

BACKGROUND OF THE INVENTION

The invention relates to water heaters, and more particularly to water heaters having foam insulation injected between the tank and the outer jacket. Still more particularly, the invention relates to arrangements for preventing such foam from reaching the electrical components between the tank and the outer jacket.

It is known to provide a fiberglass dam surrounding the electrical components and extending between the tank and the outer jacket in order to protect the electrical components from the foam. The fiberglass is compressed between the inner surface of the outer jacket and the outer surface of the tank. See, for example, U.S. Pat. No. 4,744,488.

SUMMARY OF THE INVENTION

The invention provides an improved arrangement for protecting the electrical components of a water heater from foam during injection of the foam between the tank and the outer jacket of the water heater. More particularly, the invention provides a water heater comprising a tank defining a water chamber, with conventional electrical components extending outwardly of the outer surface of the tank. The water heater also comprises an outer jacket surrounding the tank and having therein an opening affording access to the electrical components. As described more fully below, insulating foam is injected between the tank and the outer jacket.

The water heater also comprises a door which is mounted on the outer jacket and which covers the electrical components. The water heater further comprises an electric control dam for protecting the electrical components from the foam. The dam has a shape conforming to the shape of the opening in the outer jacket, and the dam is located in the opening and surrounds the electrical components.

The dam includes an inner portion which is made of flexible urethane and which sealingly engages the outer surface of the tank. The dam also includes an outer portion made of expandable polystyrene. The outer portion includes an outwardly extending lip overlapping the outer surface of the outer jacket around the opening therein. The lip is compressed between the door and the outer jacket so that the lip sealingly engages the outer jacket. The outer portion of the dam also includes an inner surface surrounding the electrical components. The inner surface has thereon a shoulder.

The water heater further comprises an insulating cap wedged within the dam. More particularly, the cap includes an outer surface wedged inside the inner surface of the dam. The portion of the inner surface which receives the cap is tapered in the direction toward the tank and toward the inside of the dam so that the cap is forced against the inner surface of the dam. The cap is spaced inwardly from the door and includes a handle that facilitates insertion and removal of the cap relative to the dam. The cap is also made of expandable polystyrene and rigidifies the dam while the foam is being injected between the tank and the outer jacket.

The water heater is assembled by providing the tank, the electrical components, the outer jacket, the dam, the cap and the door as described above. The foam is then injected between the tank and the outer jacket. Because the dam sealingly engages both the tank and the outer jacket, the foam is substantially prevented from entering the space within the dam. The foam is thereby substantially prevented from reaching the electrical components. The cap rigidifies the dam and resists the force exerted on the dam by the foam during injection of the foam.

Other features and advantages of the invention will become apparent to those skilled in the art upon review of the following detailed description, claims and drawings.

DESCRIPTION OF THE DRAWINGS

FIG. 3 is a view taken along line 3—3 in FIG. 1.

FIG. 4 is a view taken along line 4—4 in FIG. 3.

FIG. 5 is a view taken along line 5—5 in FIG. 4.

Figure 1:
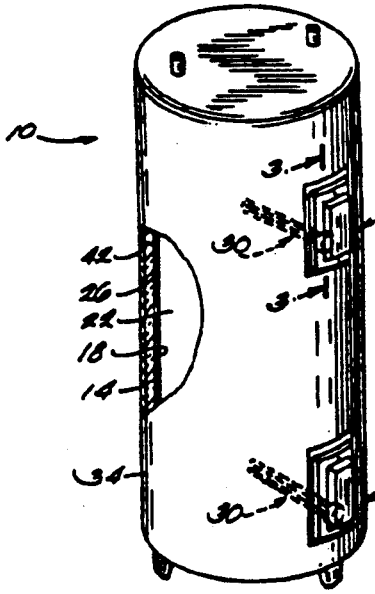
FIG. 1 is a perspective view of a water heater embodying the invention.

Before one embodiment of the invention is explained in detail, it is to be understood that the invention is not limited in its application to the details of the construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

A water heater 10 embodying the invention is illustrated in the drawings. The water heater 10 comprises (see FIG. 1) a tank 14 including an inner surface 18 defining a water chamber 22. The tank 14 also includes an outer surface 26. The water heater 10 also comprises (see FIGS. 1 and 3) electrical components 30, such as thermostats and heating elements, extending at least in part outwardly of the outer surface 26 of the tank 14.

The water heater 10 further comprises an outer jacket 34 surrounding the tank 14, having an outer surface 36 and having therein (see FIG. 2) openings 38 affording access to the electrical components 30. Hereinafter, only the upper opening 38 and the associated components of the water heater 10 will be discussed. In the illustrated construction, the opening 38 is rectangular. As shown in FIG. 1, a layer of foam insulating material 42 is located between the tank 14 and the outer jacket 34. The manner in which the insulating material 42 is placed between the tank 14 and the outer jacket 34 is described below.

The water heater 10 further comprises a door 46 which is mounted on the outer jacket 34 and which covers the opening 38. In the illustrated construction, the door 46 includes (see FIGS. 3 and 5) an inner surface 48, an outer flange portion 50 engaging the outer surface 36 of the outer jacket 34, a central portion 54 spaced a distance A (see FIG. 5) from the outer surface 36 of the outer jacket 34, and an intermediate portion 58 which is located between the central portion 54 and the outer flange portion 50 and which is spaced a distance B less than the distance A from the outer surface 36 of the outer jacket 34. The door 46 is secured to the outer jacket 34 by a plurality of screws 62 (see FIGS. 2–4) extending through the intermediate portion 58.

Figure 2:
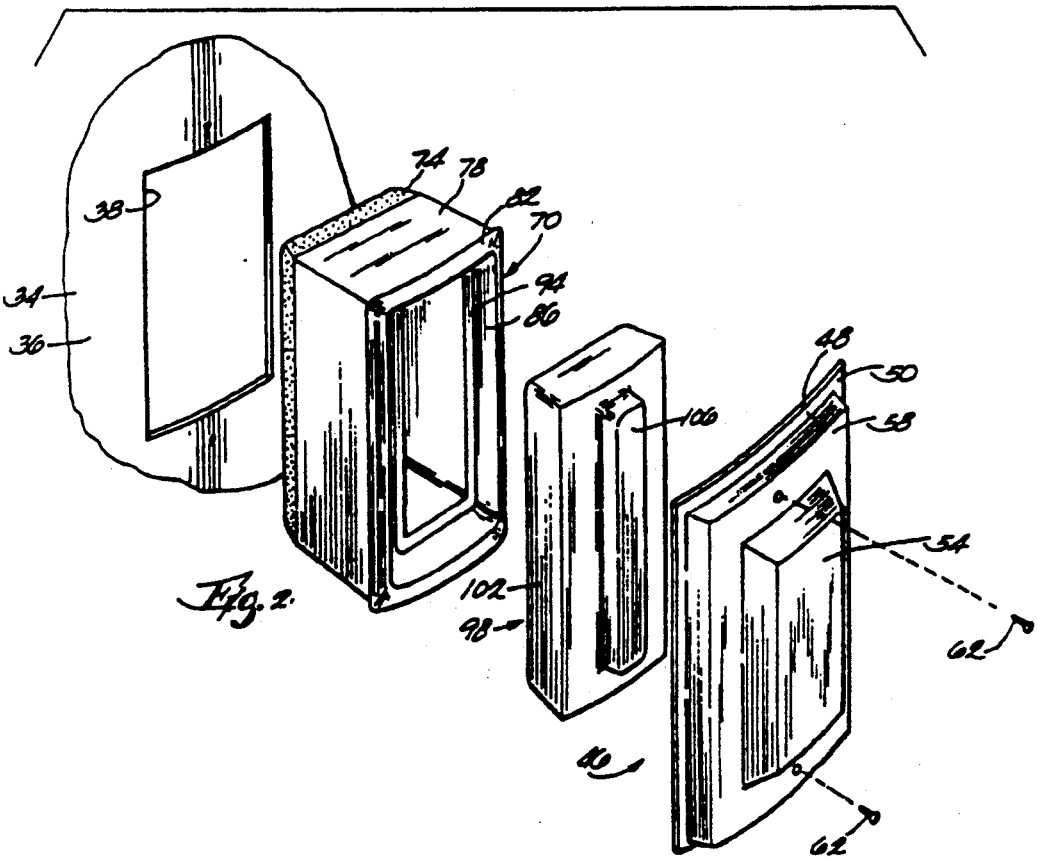
FIG. 2 is an exploded, partial view of the water heater.

The water heater 10 further comprises (see FIGS. 2, 3 and 5) a dam 70 which is located within the opening 38, which surrounds the electrical components 30, and which extends between the tank 14 and the outer jacket 34. The dam 70 is preferably rectangular, as shown in FIG. 2, so that the dam 70 fits snugly within the opening 38.

As shown in FIG. 3, the dam 70 includes a flexible inner portion 74 sealingly engaging the outer surface 26 of the tank 14. The inner portion 74 is preferably made of flexible urethane. The dam 70 also includes an outer portion 78 made of expandable polystyrene and fixed to the inner portion 74 by suitable means such as adhesive. The outer portion 78 includes, adjacent the outer end thereof, a lip or portion 82 extending between the door 46 and the outer jacket 34. More particularly, the lip 82 extends between the intermediate portion 58 of the door 46 and the outer surface 36 of the jacket 34, and the lip 82 is compressed between the inner surface 48 of the door 46 and the outer surface 36 of the jacket 34. The lip 82 consequently sealingly engages the outer surface 36 of the jacket 34. The outer portion 78 of the dam 70 also includes an inner surface 86 defining a space 90 containing the electrical components 30. As shown in FIGS. 2 and 3, the inner surface 86 has thereon a shoulder 94.

The water heater 10 further comprises (see FIGS. 2–5) an insulating cap 98 made of expandable polystyrene which is seated within the dam 70 and which extends over the electrical components 30. The cap 98 engages the shoulder 94 and includes an outer surface 102 engaging the inner surface 86 of the dam 70. More particularly, the outer surface 102 of the cap 98 is wedged against the inner surface 86 of the dam 70. The portion of the inner surface 86 which receives the cap 98 is tapered in the direction toward the tank 14 and toward the inside of the dam 70 so that the cap 98 is forced against the dam inner surface 86. The cap 98 also includes a handle 106 facilitating insertion of the cap 98 into the dam 70 and removal of the cap 98 from the dam 70. The handle 106 and the remainder of the cap 98 are spaced inwardly, i.e., in the direction toward the tank 34, from the central portion 54 of the door 46.

The water heater 10 is assembled as follows. First, the tank 34, the electrical components 30, the outer jacket 34 and the dam 70 are arranged as described above. Next, the cap 98 is inserted into the dam 70, as described above. Next, the door 46 is secured over the dam 70 and the cap 98 so that the lip 82 of the dam 70 is compressed between the door 46 and the outer jacket 34. Last, foam 42 is injected between the tank 14 and the outer jacket 34 and around the dam 70 to provide insulation between the tank 14 and the outer jacket 34. Because the dam 70 sealingly engages both the tank 14 and the outer jacket 34, the dam 70 keeps substantially all of the foam 42 outside of the dam 70 and thereby substantially prevents the foam 42 from reaching the electrical components 30. The cap 98 rigidifies the dam 70 and helps the dam 70 to resist the force exerted on the dam 70 by the foam 42 during injection of the foam 42.

Various features of the invention are set forth in the following claims.

I claim:

1. A water heater comprising a tank including an outer surface, and including an inner surface defining a water chamber, an electrical component extending outwardly of said outer surface of said tank, an outer jacket surrounding said tank and having therein an opening affording access to said electrical component, and including an outer surface facing away from said tank, a door which is mounted on said outer jacket, which covers said opening, and which has an inner surface facing said tank, a dam which is located within said opening, which surrounds said electrical component, and which includes a lip extending between and compressed between said inner surface of said door and said outer surface of said outer jacket, and insulating material located between said tank and said outer jacket and outside of said dam.

2. A water heater as set forth in claim 1 wherein said dam includes a flexible inner portion sealingly engaging said outer surface of said tank, and an expandable polystyrene outer portion including said portion extending between said door and said outer jacket.

3. A water, heater as set forth in claim 1 wherein said dam includes an inner surface defining a space containing said electrical component, and wherein said water heater further comprises a cap extending over said electrical component and engaging said inner surface of said dam.

4. A water heater as set forth in claim 3 wherein said inner surface of said dam has thereon a shoulder, and wherein said cap engages said shoulder.

5. A water heater as set forth in claim 3 wherein said inner surface of said dam which receives said cap is tapered in the direction toward said tank and toward the inside of said dam, and wherein said cap includes an outer surface wedged against said inner surface.

6. A water heater as set forth in claim 3 wherein said cap is spaced from said door in the direction toward said tank.

7. A water heater as set forth in claim 3 wherein said cap has thereon a handle.

8. A water heater as set forth in claim 3 wherein said water heater is manufactured by placing said cap in engagement with said inner surface of said dam before said insulating material is placed between said tank and said outer jacket, and wherein said cap rigidifies said dam during placement of said insulating material between said tank and said outer jacket.

9. A water heater comprising a tank including an outer surface, and including an inner surface defining a water chamber, an electrical component extending outwardly of said outer surface of said tank, an outer jacket surrounding said tank and having therein an opening affording access to said electrical component, a dam which is located within said opening, and which includes an inner surface defining a space containing said electrical component, insulating material located between said tank and said outer jacket and outside of said dam, and a cap which is not an electrical component, which extends over said electrical component and which engages said inner surface of said dam so that said cap rigidifies said dam.

10. A water heater as set forth in claim 9 wherein said dam includes a flexible inner portion sealingly engaging said outer surface of said tank, and an expandable polystyrene outer portion engaging said outer jacket.

11. A water heater as set forth in claim 9 wherein said inner surface of said dam has thereon a shoulder, and wherein said cap engages said shoulder.

12. A water heater as set forth in claim 9 wherein said inner surface of said dam is tapered in the direction toward said tank and toward the inside of said dam, and wherein said cap includes an outer surface wedged against said inner surface.

13. A water heater as set forth in claim 9 wherein said cap has thereon a handle.

14. A water heater as set forth in claim 9 wherein said water heater is manufactured by placing said cap in engagement with said inner surface of said dam before said insulating material is placed between said tank and said outer jacket.

15. A water heater as set forth in claim 9 and further comprising a door which is mounted on said outer jacket and which covers said dam and said cap.

16. A water heater as set forth in claim 15 wherein said cap is spaced from said door in the direction toward said tank.

17. A method for manufacturing a water heater, said method comprising the steps of providing a tank including an outer surface, and including an inner surface defining a water chamber, providing an electrical component extending outwardly of said outer surface of said tank, providing an outer jacket surrounding said tank and having therein an opening affording access to said electrical component, providing a dam which is located within said opening, and which includes an inner surface defining a space containing said electrical component, providing a cap which is not an electrical component which extends over said electrical component and which engages said inner surface of said dam so as to rigidify said dam, and thereafter injecting foam between said tank and said outer jacket and around said dam to provide insulation between said tank and said outer jacket.

18. A method as set forth in claim 17 and further comprising the step of providing a door which is mounted on said outer jacket and which covers said dam and said cap.

19. A water heater comprising a tank including an outer surface, and including an inner surface defining a water chamber, an electrical component extending outwardly of said outer surface of said tank, an outer jacket surrounding said tank and having therein an opening affording access to said electrical component, a dam which is located within said opening, and which includes an inner surface defining a space containing said electrical component, said inner surface of said dam having thereon an outwardly facing shoulder, insulating material located between said tank and said outer jacket and outside of said dam, and a cap extending over said electrical component engaging said inner surface of said dam so that said cap rigidifies said dam, and engaging said shoulder such that said shoulder limits inward movement of said cap.

20. A water heater comprising a tank including an outer surface, and including an inner surface defining a water chamber, an electrical component extending outwardly of said outer surface of said tank, an outer jacket surrounding said tank and having therein an opening affording access to said electrical component, a dam which is located within said opening, and which includes an inner surface defining a space containing said electrical component, insulating material located between said tank and said outer jacket and outside of said dam, a cap extending over said electrical component and engaging said inner surface of said dam so that said cap rigidifies said dam, and a door which is mounted on said outer jacket and which covers said dam and said cap.

* * * * *